United States Patent [19]

Worden

[11] 4,195,700

[45] Apr. 1, 1980

[54] LARGE DIAMETER BIT WITH SWEEP PICKUP

[75] Inventor: Euclid P. Worden, Dana Point, Calif.

[73] Assignee: Smith International, Inc., Newport Beach, Calif.

[21] Appl. No.: 933,160

[22] Filed: Aug. 14, 1978

[51] Int. Cl.[2] ..... E21C 13/02

[52] U.S. Cl. ..... 175/340; 175/313; 175/393

[58] Field of Search ..... 175/215, 313, 339, 340, 175/393; 299/81; 15/415 A

[56] References Cited

U.S. PATENT DOCUMENTS

| | | | |
|---|---|---|---|
| 1,318,881 | 10/1919 | Kelley | 15/415 A |
| 3,360,061 | 12/1967 | Canalizo | 175/215 X |
| 3,384,191 | 5/1968 | Schumacher, Jr. et al. | 175/340 |
| 4,105,083 | 8/1978 | Allen | 175/340 X |

*Primary Examiner*—Ernest R. Purser
*Assistant Examiner*—Nick A. Nichols, Jr.
*Attorney, Agent, or Firm*—Robert M. Vargo

[57] ABSTRACT

An improved sweep pickup for large diameter bits is disclosed in which the flow rate of drilling fluid through the pickup tube is constant, thereby enhancing its lifting capacity. The sweep pickup comprises an elongated tube extending radially across the bottom face of the drill bit. The pickup tube is truncated longitudinally on the bottom side thereof by a horizontal plate having the pickup inlet opening formed therein. The plate truncates the tubular portion of the pickup at an angle to provide an increasing vertical cross-section in the direction of the pickup outlet which is toward the center of the drill bit body. In the preferred configuration, the vertical cross-sectional area with the pickup tube at any point is equal to the area of the inlet opening from that point radially outward to the outer extremity thereof. As a result, the flow rate of drilling fluid through the sweep pickup is constant and equal to the flow rate through the interior of the drill string.

4 Claims, 5 Drawing Figures

LARGE DIAMETER BIT WITH SWEEP PICKUP

BACKGROUND OF THE INVENTION

1. Field of the Invention

The present invention relates generally to the art of drilling large diameter boreholes in earth formations and, more particularly, to the methods of removing the cuttings from the borehole during the drilling operation.

2. Description of the Prior Art

In the drilling of large boreholes and well shafts in earth formations, a large diameter drill bit, having cutters mounted on the lower portion thereof, is secured to the lower end of a hollow drill stem which is lowered and rotated to cause the cutters to roll on the bottom of the borehole being produced to cut or crush the formation being encountered.

Circulation systems utilizing drilling fluid such as water, mud or air are used to cool and clean the bit and remove the cuttings produced by the drilling operation from the borehole. The fluid may be pumped downwardly through the drill stem and bit head and rise in the annulus area between the drill stem and the wall of the hole to the surface of the earth to carry the cuttings from the hole. A reverse flow of drilling fluid may be employed by pumping the drilling fluid downwardly through the annulus area and then upwardly through the interior of the drill stem.

The shortcoming with direct circulation systems in large borehole applications is that the removal of the cuttings is not accomplished efficiently. This is because a large amount of cuttings is produced in such operations and since the annulus area is much larger than the interior of the drill string the return velocity of the drilling fluid through the annulus area is greatly reduced thereby reducing its lifting capacity. For this reason, reverse circulation systems are preferred in large borehole drilling.

Drill bits utilizing reverse circulation systems usually include a radially extending pickup tube located at the face of the drill bit having an opening extending from a point adjacent the axis of rotation of the bit to a point adjacent the gage area of the hole being drilled. The other end of the pickup tube communicates with the interior of the drill stem. Heretofore, such pickup tubes were usually fabricated totally or partially from flat plates configured in such a manner to create undesirable flow characteristics for the drilling fluid. It has been postulated that effective reverse circulation cuttings removal is dependent on constant or increasing fluid velocities from the pickup opening to the discharge point. To attain this end with constant fluid flow rates, the cross-sectional area of the circulation system must be maintained constant or must decrease toward the discharge. This has not been done in present day sweep pickup systems. Such systems usually have enlarged areas between the extremities thereof which create a reduction in fluid flow which is deleterious to the lifting capabilities of the fluid. Such a system is shown in U.S. Pat. No. 3,384,191.

SUMMARY OF THE INVENTION

The present invention obviates the above-mentioned shortcoming by providing an improved sweep pickup for large diameter drill bits configured to have constant fluid flow of the drilling fluid passing therethrough. In its broadest aspect, the present invention pertains to a large diameter drill bit comprising a main bit body having a plurality of rolling cutters rotatively mounted thereon. A radially extending sweep pickup is mounted on the main bit body having an opening extending from a point adjacent the axis of rotation of the drill bit to a point adjacent the gage area of the hole being drilled. The sweep pickup has a tubular configuration which has the same inside diameter as the other components of the circulating system. The tube is truncated longitudinally by a horizontal surface which contains the pickup opening. According to the present invention, the vertical cross-sectional area within the tube at any point is equal to the area of the pickup opening from that point outwardly. This provides a gradually increasing cross-section as the full area of the pickup tube is approached. As a result, the fluid velocity inside the sweep is maintained at a constant rate.

The features of the present invention, which are believed to be novel, are set forth with particularity in the appended claims. The present invention, both as to its organization and manner of operation, together with the further advantages thereof, may best be understood by reference to the following description taken in connection with the accompanying drawings.

DESCRIPTION OF THE PREFERRED EMBODIMENT

Figure 1:
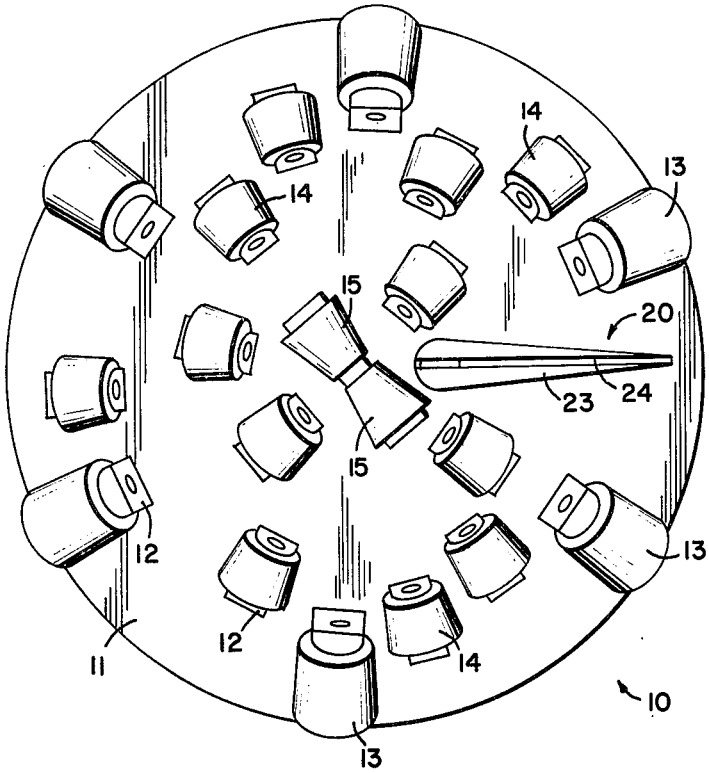
FIG. 1 is a bottom plan view of a large diameter drill bit, utilizing the sweep pickup system in accordance with the present invention.

Referring now to the drawings, FIG. 1 illustrates a large diameter drill bit, generally indicated by arrow 10, which includes a bit body having a lower plate 11. A plurality of yokes or saddles 12 are integrally attached to the plate 11, having a plurality of roller cutters 13–15 rotatively mounted thereon.

The cutters 13, which are mounted adjacent the circumference of the plate 11, form the gage row of cutters which function to cut the outer diameter of the borehole. Intermediate cutters 14 are mounted on the interior of the plate 11 while two inner-cutters 15 are mounted at the center of the drill bit 10. During operation, the drill bit 10 is rotated to enable the cutters 13–15 to roll on the bottom of the borehole being produced to cut or crush the formations being encountered.

The circulation system utilized is a reverse flow system, in which the drilling fluid is pumped downwardly through the annulus area of the borehole, around the outer edge of the plate 11 and across the bottom face thereof. The drilling fluid is then picked up by a sweep pickup assembly, generally indicated by arrow 20. The sweep pickup assembly 20 is mounted on the bottom of the lower plate 11 and extends radially from a point adjacent the axis of rotation of the drill bit to a point adjacent the gage area of the hole being drilled. The sweep pickup assembly 20 includes a central conduit 21 which extends through the interior of the drill bit 10 and communicates with the interior of the drill column (not shown).

The sweep pickup assembly 20 further includes a pickup tube 22 attached to and extending radially outwardly from the central conduit 21. The pickup tube 22 is angled downwardly as it extends away from the central conduit 21 and is truncated longitudinally by a horizontal plate 23. A pickup opening 24 is formed within the plate 23 and extends along the entire length thereof.

Figure 4:
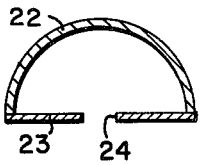
FIG. 4 is a sectional view of the sweep pickup tube taken along lines 4—4 of FIG. 3.
Figure 5:
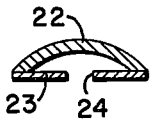
FIG. 5 is a sectional view of the sweep pickup tube taken along lines 5—5 of FIG. 3.
Figure 2:
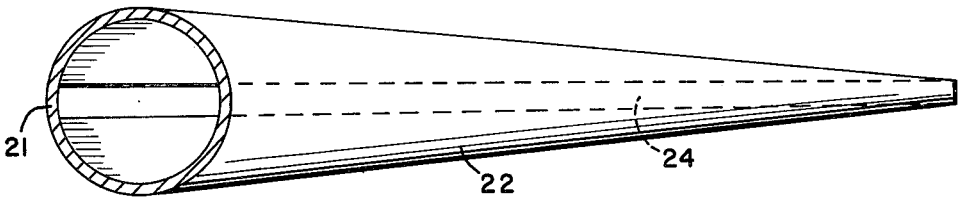
FIG. 2 is an enlarged plan view, partially in section, of the sweep pickup tube of the present invention.
Figure 3:
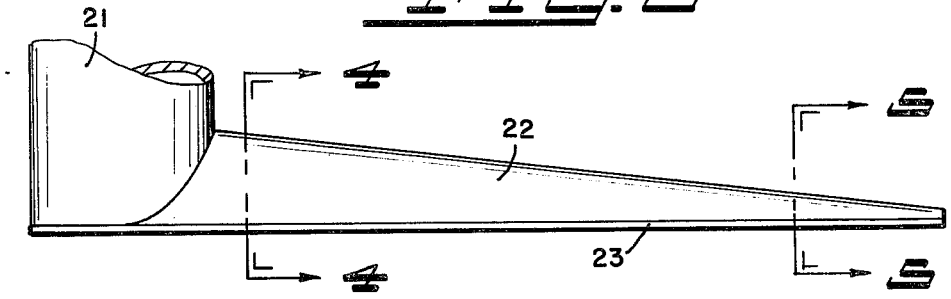
FIG. 3 is an enlarged elevational view of the sweep pickup tube.

According to the present invention, the vertical cross-sectional area within the pickup tube 22, at any point, is equal to the area of the pickup opening 24 from that point radially outwardly. For example, the cross-sectional area of the pickup tube 22, as shown in FIG. 5, is substantially equal to the area of the pickup opening 24 from the point shown along lines 5—5 of FIG. 3 to the outer extremity of the pickup tube 22. Moving radially inwardly, the cross-sectional area of the pickup tube 22, as shown in FIG. 4, is equal to the area of the pickup opening 24, taken from the point 4—4, shown in FIG. 4, to the outer extremity of the pickup tube 22. This gradual increase in cross-sectional area increases until the full area of the central conduit 21 is approached. Therefore, as the drill bit 10 rotates along the bottom of the borehole, the sweep pickup assembly 20 is swept across the bottom face of the borehole, picking up the drilling fluid through the pickup opening 24. The fluid then passes inwardly and upwardly through the pickup tube 22 and finally passes into the central conduit 21 for travel up the interior of the drill column. Because of the gradual increase of cross-sectional area within the pickup tube 22, there are no enlarged areas which slow the flow rate of the drilling fluid and impair the lifting capacity of the fluid.

In accordance with the present invention, the flow rate is constant along the entire length of the pickup tube. As a result, the fluid velocity inside the sweep pickup tube 22 is maintained at a constant rate, thereby enabling the drilling fluid to smoothly and efficiently carry the cuttings and other debris up through the pickup assembly 20 and the interior of the drill column to the surface of the well.

It should be noted that various modifications can be made to the assembly while still remaining within the purview of the following claims.

What is claimed is:

1. A large diameter bit comprising:

a main bit body having a lower plate;

a plurality of cutter assemblies rotatively attached to said lower plate, said cutters extending downwardly therefrom to engage and disintegrate the formation at the face of a borehole; and a sweep pickup assembly communicating with the interior of the drill column and having means for receiving drilling fluid along the face of the borehole and passing it therethrough to the interior of the drill column, said sweep pickup assembly comprising a central conduit connected to a radially extending pickup tube, said pickup tube having means for maintaining a constant flow of drilling fluid passing therethrough, said pickup tube extending from and adjacent to the central axis of the drill bit radially outward to a point adjacent the gage area of the drill bit, said pickup tube including an inlet opening extending along its entire length, with the vertical cross-sectional area of the pickup tube, at any point along the length of the tube, being substantially equal to the area of the inlet from that point to the outer extremity thereof.

2. The combination of claim 1 wherein said pickup tube includes a radially extending conical portion, said conical portion being truncated on its lower side by a horizontal plate having said inlet opening formed therein.

3. A sweep pickup assembly for a large diameter bit comprising:

a central conduit adapted to be located adjacent the center axis of the drill bit to communicate with the interior of the drill column; and a pickup tube attached at one end of said central conduit, said pickup tube adapted to extend outwardly across the radius of the drill bit, said pickup tube having an inlet opening extending along its entire length for receiving drilling fluid passing therethrough, said pickup tube further having means for maintaining a constant flow of drilling fluid passing therethrough, the vertical cross-sectional area of the pickup tube, at any point along the length of the tube, being substantially equal to the area of the inlet from that point to the outer extremity thereof.

4. The combination of claim 3 wherein said pickup tube includes a radially extending conical portion, said conical portion being truncated on its lower side by a horizontal plate having said inlet opening formed therein.

* * * * *